US010427762B1

(12) United States Patent
Mosher

(10) Patent No.: US 10,427,762 B1
(45) Date of Patent: Oct. 1, 2019

(54) BOAT SEAT

(71) Applicant: Matthew Gregory Mosher, Union, MO (US)

(72) Inventor: Matthew Gregory Mosher, Union, MO (US)

( * ) Notice: Subject to any disclaimer, the term of this patent is extended or adjusted under 35 U.S.C. 154(b) by 0 days.

(21) Appl. No.: 15/962,994

(22) Filed: Apr. 25, 2018

(51) Int. Cl.

| | |
|---|---|
| ***B63B 29/04*** | (2006.01) |
| ***B63B 29/06*** | (2006.01) |
| ***A47C 3/18*** | (2006.01) |
| ***A47C 3/12*** | (2006.01) |

(52) U.S. Cl.
CPC ..... *B63B 29/06* (2013.01); *A47C 3/12* (2013.01); *A47C 3/18* (2013.01); *B63B 2029/043* (2013.01)

(58) Field of Classification Search
CPC ..... B63B 29/06; A47C 3/12; A47C 3/18
USPC ..... 297/452.14, 452.15, 344.18, 344.19, 461
See application file for complete search history.

(56) References Cited

U.S. PATENT DOCUMENTS 3,512,835 A * 5/1970 Flototto ..... A47C 7/16 297/452.14
3,669,496 A * 6/1972 Chisholm ..... A47C 5/12 297/452.15 X
3,883,176 A * 5/1975 Morton ..... A47C 3/12 297/452.14
4,418,958 A * 12/1983 Watkin ..... A47C 3/12 297/452.15
4,892,356 A * 1/1990 Pittman ..... A47C 3/12 297/452.15
4,981,326 A * 1/1991 Heidmann ..... A47C 3/026 297/452.15 X
5,102,196 A * 4/1992 Kaneda ..... A47C 7/405 297/452.15 X
5,314,240 A * 5/1994 Ishi ..... A47C 1/03255 297/452.15
5,318,346 A * 6/1994 Roossien ..... A47C 3/12 297/452.15 X
5,577,811 A * 11/1996 Ogg ..... A47C 3/12 297/452.14 X
5,957,534 A * 9/1999 Wilkerson ..... A47C 1/03255 297/452.14 X
6,634,717 B2 * 10/2003 Kown ..... A47C 3/023 297/452.14 X
6,722,735 B2 * 4/2004 Lucci ..... A47C 3/04 297/452.15 X
7,422,284 B2 * 9/2008 Hartenstine ..... A47D 13/105 297/452.15 X (Continued)

*Primary Examiner* — Rodney B White
(74) *Attorney, Agent, or Firm* — Gulf Coast Intellectual Property Group

(57) ABSTRACT

A boat seat configured to be mounted on a post in a suitable location on a boat. The boat seat includes a frame having a bottom portion and an upper portion. The bottom portion and upper portion are perpendicular in orientation. Contiguously formed with the bottom portion and upper portion providing operable coupling thereof are a first arm member and a second arm member. The first arm member and second arm member are located on opposing sides of the frame. The first arm member and second arm member include lower sections and upper sections wherein the lower sections are arcuate in shape. The bottom portion has apertures configured to facilitate securing of the frame to a mounting post. A first support member and second support member are provided wherein the second support member is secured to the upper portion of the frame.

7 Claims, 3 Drawing Sheets

(56) References Cited

U.S. PATENT DOCUMENTS

| | | | | |
|---|---|---|---|---|
| 8,282,172 | B2 * | 10/2012 | Schmitz | A47C 1/03255 297/452.14 X |
| 2002/0149253 | A1 * | 10/2002 | MacDonald | B60N 2/24 297/452.14 |
| 2004/0251729 | A1 * | 12/2004 | Olson | A47C 3/023 297/452.14 |
| 2005/0001464 | A1 * | 1/2005 | Caruso | A47C 1/03 297/452.14 |
| 2009/0195047 | A1 * | 8/2009 | Bouche | A47C 3/04 297/452.14 |
| 2012/0267934 | A1 * | 10/2012 | Fewchuk | A47C 5/12 297/452.14 X |
| 2014/0077573 | A1 * | 3/2014 | Schneider | A47C 3/12 297/452.14 |
| 2016/0106216 | A1 * | 4/2016 | Mehaffey | A47C 3/12 297/452.14 |

* cited by examiner

BOAT SEAT

PRIORITY UNDER 35 U.S.C Section 119(e) & 37 C.F.R. Section 1.78

This nonprovisional application claims priority based upon the following prior U.S. Provisional Patent Application entitled: Butt seat back brace, Application No. 62/603,153 filed May 19, 2017, in the name of Matthew Gregory Mosher, which is hereby incorporated by reference for all purposes.

FIELD OF THE INVENTION

The present invention relates generally to boat seating but not by way of limitation a boat seat for a boat, configured to be mounted in the bow of a bass boat or other suitable location, wherein the boat seat is rotatably mounted on a pole and provides a horizontal support surface and vertical support surface that are perpendicular to each other and configured to provide support to a user in a seated and standing position.

BACKGROUND

Millions of individuals regularly engage in the sport of fishing. There are numerous categories of fishing such as but not limited to saltwater, freshwater, inshore and offshore. One popular category of fishing is freshwater fishing. Freshwater fishing is executed on inland lakes and ponds and can be done either from the shore or a boat. One popular style of boat for fresh water fishing is a bass boat. Bass boats as known in the art are shallow water boats with low gunwales that typically have a seating arrangement that includes a single seat centered on the keel proximate the bow of the boat. This conventional seat arrangement is utilized once anchored or drifting for fishing and provides a horizontal support surface for users thereof.

The aforementioned bow seat for conventional bass boats lacks any support surface other than a horizontal support surface. A user superposed on a conventional bow seat of a bass boat is unable to lean back and obtain support from any structural element for their back. Additionally, if a user is fishing from the bow of a bass boat configured with a conventional post seat, the user is not provided any support from a conventional post seat during a standing position.

Accordingly, there is a need for a boat seat configured to be mounted on the bow of a bass boat or other suitable location wherein the boat seat is structured to provide back support for a user seated thereon and further configured to provide support for a user that is standing adjacent thereto.

SUMMARY OF THE INVENTION

It is the object of the present invention to provide a boat seat that is configured to provide a horizontal support surface and a vertical support surface for a user so as to provide a seated position and a standing position and support thereof.

Another object of the present invention is to provide a boat seat configured to be rotatably mounted in a suitable location of a boat wherein the boat seat includes a frame having a lower portion and an upper portion that are contiguously formed and perpendicular to each other.

A further object of the present invention is to provide a boat seat operable to provide support for a user in a seated position and a standing position wherein the bottom portion of the frame includes apertures configured to facilitate the mounting of the frame to a post member.

Still another object of the present invention is to provide a boat seat rotatably mounted to a boat that includes a first arm member and a second arm member contiguously formed with the lower portion extending rearward and upward therefrom.

An additional object of the present invention is to provide a boat seat operable to provide support for a user in a seated position and a standing position wherein the first arm member and second arm member are positioned on opposing sides of the bottom portion.

Yet a further object of the present invention is to provide a boat seat rotatably mounted to a boat wherein a void is present intermediate the first arm member and the second arm member.

Another object of the present invention is to provide a boat seat operable to provide support for a user in a seated position and a standing position wherein the upper portion is integrally formed with the first arm member and the second arm member distal to the bottom portion.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
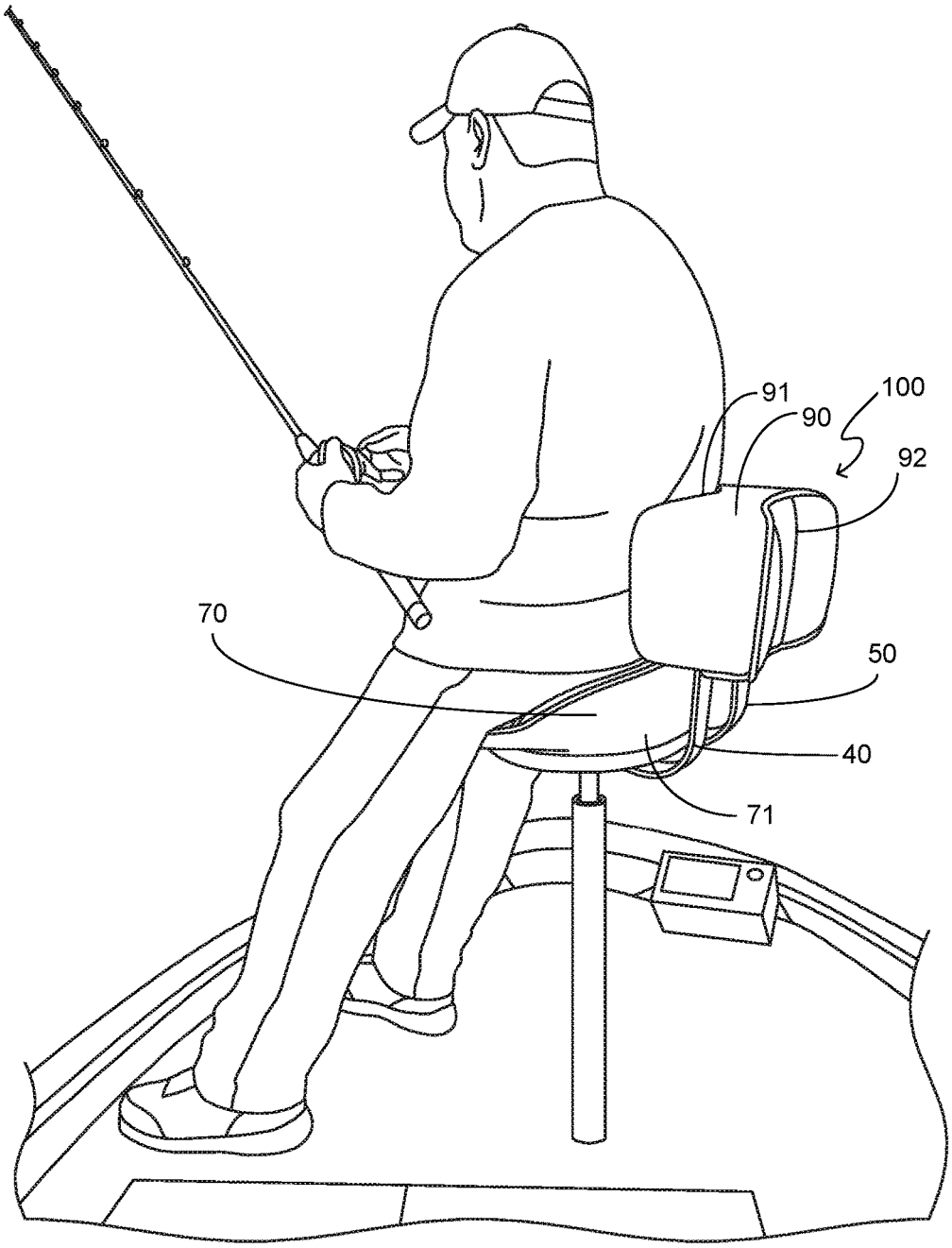
FIG. 1 is a side perspective view of the preferred embodiment of the present invention.
Figure 2:
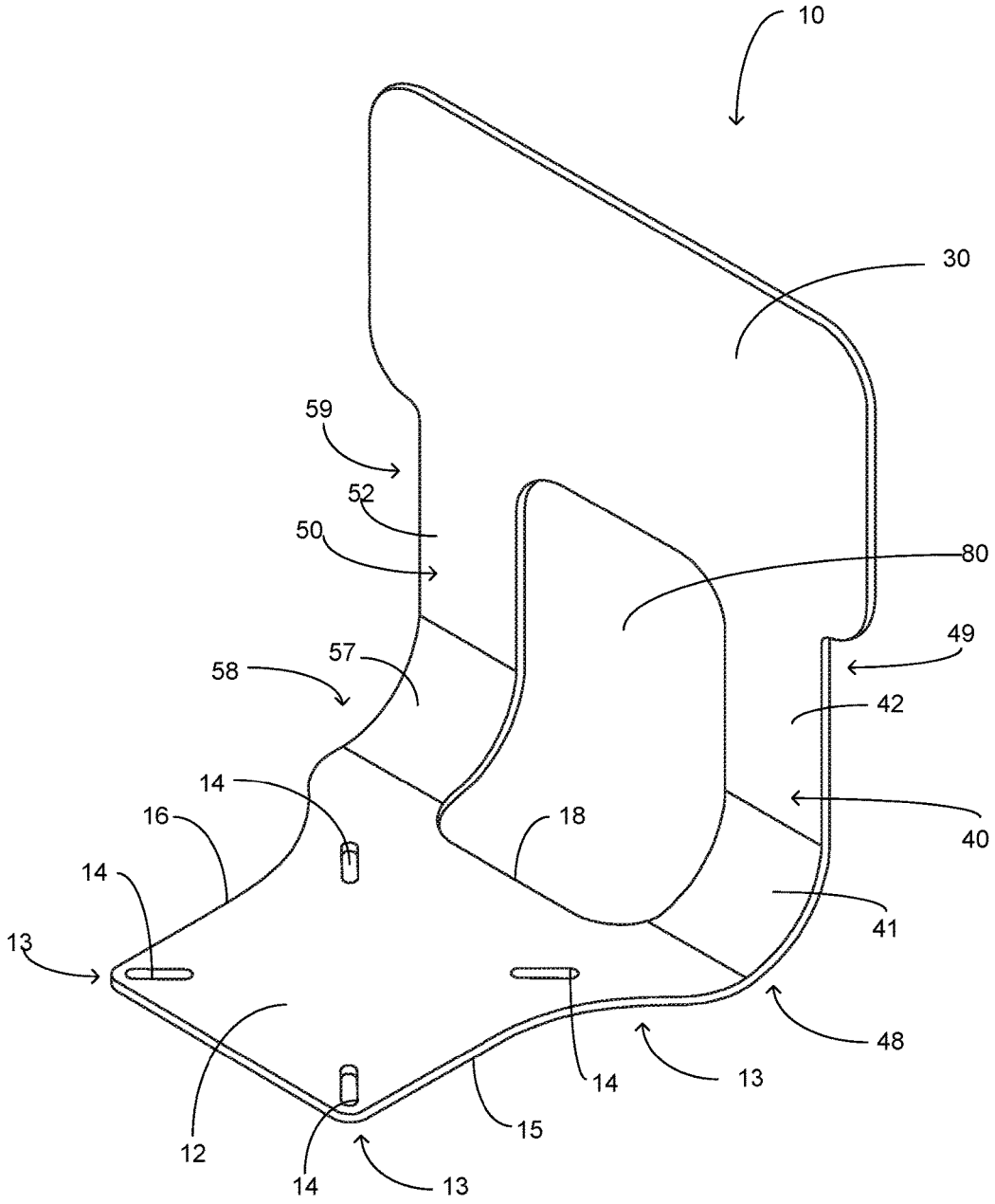
FIG. 2 is front perspective view of the frame of the present invention.
Figure 3:
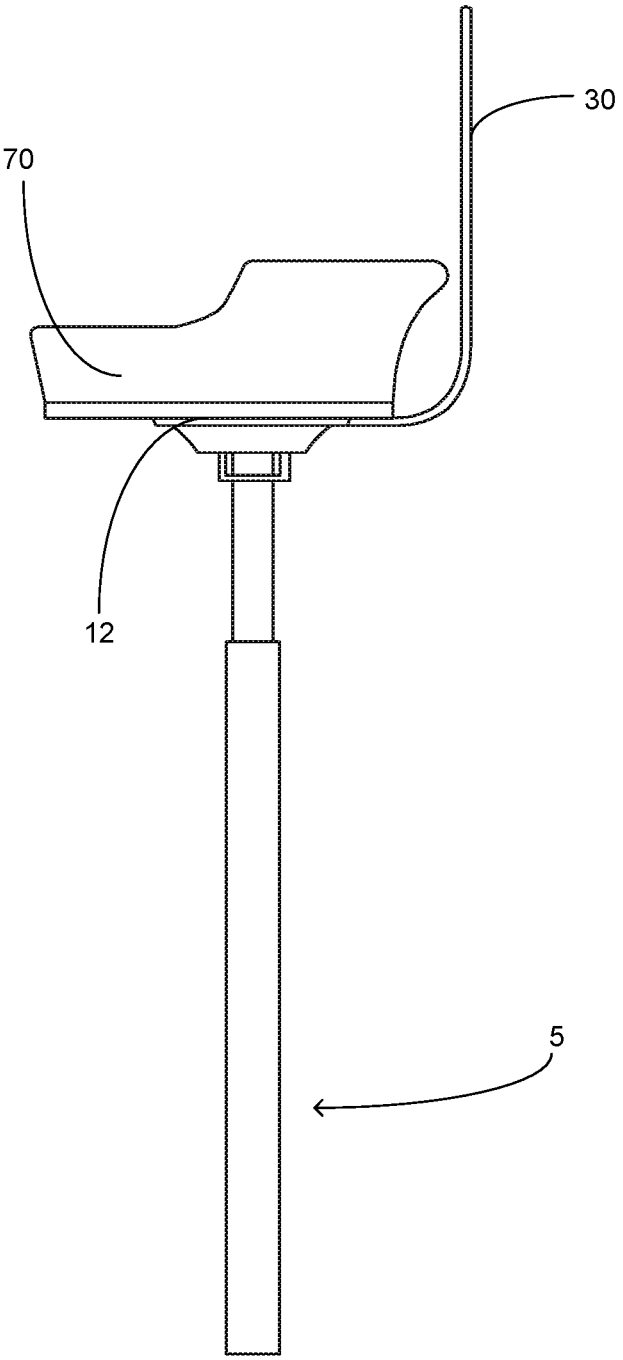
FIG. 3 side view of the present invention.

Referring now to the drawings submitted herewith, wherein various elements depicted therein are not necessarily drawn to scale and wherein through the views and figures like elements are referenced with identical reference numerals, there is illustrated a boat seat 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular 2 herein the boat seat 100 includes frame 10. Frame 10 is manufactured from a suitable durable material such as but not limited to aluminum. The frame 10 includes a bottom portion 12 that is planar in manner being configured so as to superpose mounting post 5. Bottom portion 12 includes apertures 14 proximate the corners 13 that are oval in shape. The oval shape of the apertures 14 allows accommodation for slightly different bolt patterns that may be present in the mounting post 5. While a preferred shape of the apertures 14 has been disclosed herein, it is contemplated within the scope of the present invention that the apertures 14 could be formed in alternate shapes. Furthermore, while four apertures 14 are disclosed, it should be understood within the scope of the present invention that the bottom portion 12 could have more or less than four apertures 14 in order to accommodate alternate mounting configurations for the mounting post 5.

The bottom portion 12 includes a left lateral edge 15 and a right lateral edge 16 that taper outward proximate the rear edge 18 of the bottom portion 12. This configuration provides the necessary structure to transition to a top portion 30 that has a width that is greater than that of the bottom portion 12 as will be further discussed herein. Contiguously formed with the bottom portion 12 along the left lateral edge 15 is the first arm member 40. The first arm member 40 includes lower section 41 and upper section 42. The lower section 41 extends downward in an arcuate shape so as to accommodate support member 70, in particular the rear edge 71 thereof. The lower section 41 is contiguously formed with the upper section 42 wherein the upper section 42 is substantially perpendicular to the bottom portion 12. The first arm member 40 includes first end 48 and second end 49 and is manufactured from the same material as the bottom portion 12 and is contiguously formed therewith. The first arm member 40 is structured so as to provide some resiliency during use thereof. The spring like motion provided by the first arm member 40 absorbs impact of wave action, which reduces the force transferred to a user of the boat seat 100.

A second arm member 50 is contiguously formed with the bottom portion 12 along the right lateral edge 16. The second arm member 50 includes lower section 51 and upper section 52. The lower section 51 extends downward in an arcuate shape so as to accommodate support member 70, in particular the rear edge 71 thereof. The lower section 51 is contiguously formed with the upper section 52 wherein the upper section 52 is substantially perpendicular to the bottom portion 12. The second arm member 50 includes first end 58 and second end 59 and is manufactured from the same material as the bottom portion 12 and is contiguously formed therewith. Similarly as to the first arm member 40, the lower section 51, in particular the arcuate form thereof, provides a resiliency in order to offer a spring like movement to a user engaged with the upper portion 30. The spring like motion provided by the first arm member 40 and second arm member 50 absorbs impact of wave action, which reduces the impact force transferred to a user of the boat seat 100.

A void 80 is intermediate the first arm member 40 and the second arm member 50. The void 80 functions to reduce the overall weight for the frame 10 and further assist in the formation of the first arm member 40 and second arm member 50 providing the functionality previously discussed herein. While the void 80 is illustrated herein as being a particular shape and size, it is contemplated within the scope of the present invention that the void 80 could be formed in various shapes and sizes.

The upper portion 30 is contiguously formed with the second ends 49,59 of the first arm member 40 and second arm member 50. The upper portion 30 is perpendicular in orientation to the bottom portion 12. The upper portion 30 is rectangular is shape and provides the necessary structural support for the second support member 90. It is contemplated within the scope of the present invention that the upper portion 30 could be formed in alternate shapes and sizes in order to provide the desired functionality as described herein.

The boat seat 100 includes support member 70 and second support member 90. The support member 70 and second support member 90 are manufactured from a suitable material such as but not limited to foam and function as the user interface for the boat seat 100. The support member 70 is secured to the bottom portion 12 of the frame 10 utilizing suitable durable techniques. The second support member 90 includes a first side 91 and second side 92. The first side 91 and second side 92 are both inwardly arcuate in shape. The aforementioned shape of the first side 91 and second side 92 provides secure engagement of a user's lower back. The boat seat 100 is designed to be utilized in a seated position and a standing position. In a seated position, the user is superposed the support member 90 and their lower back is engaged with the first side 91. In the standing position, a user is standing adjacent to the boat seat 100 wherein the user can lean against the second side 92 of the second support member 90. The specific construction of the boat seat 100 described herein facilitates utilization of the boat seat 100 as a seat and as a leaning post for a user.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A boat seat configured to be mounted proximate a bow of a boat comprising:

a frame, said frame having a bottom portion, said bottom portion being planar in manner, said bottom portion having a left side and a right side, said bottom portion having a front edge, said bottom portion having a left lateral edge and a right lateral edge, said bottom portion having a rear edge;

a first arm member, said first arm member being contiguously formed with said bottom portion, said first arm member having a lower section and an upper section, said first arm member being formed on the left side of the bottom portion extending away from said rear edge, said first arm member having a first end and a second end and wherein said lower section of the first arm member is arcuate in shape;

a second arm member, said second arm member being contiguously formed with said bottom portion opposite said first arm member, said second arm member having a lower section and an upper section, said second arm member having a first end and a second end and wherein the lower section of said second arm member is arcuate in shape;

a void, said void being intermediate said first arm member and said second arm member;

an upper portion, said upper portion being contiguously formed with said first arm member and said second arm member distal to said bottom portion, said upper portion being perpendicular in orientation to said bottom portion and wherein the upper portion has a width that is greater than a width of the bottom portion.

2. The boat seat as recited in claim 1, and further including a first support member and a second support member, said second support member being secured to said upper portion, said second support member having a first side and a second side, said first side and said second side of said second support member being inwardly arcuate in form.

3. The boat seat as recited in claim 2, wherein the bottom portion further includes a plurality of apertures, said plurality of apertures configured to facilitate mounting of the boat seat to a mounting post.

4. A boat seat configured to be mounted proximate a bow of a boat that provides a first engagement technique and a second engagement technique comprising:

a frame, said frame having a bottom portion, said bottom portion being planar in manner, said bottom portion having a left side and a right side, said bottom portion having a front edge and a rear edge, said bottom portion having a left lateral edge, said left lateral edge formed so as to taper outward proximate said rear edge, said right lateral edge formed so as to taper outward proximate said rear edge, said frame having four apertures, said four apertures being formed in said bottom portion, said four apertures being oval in shape, said four apertures configured to facilitate mounting of the frame to a mounting post;

a first arm member, said first arm member being contiguously formed with said bottom portion, said first arm member having a lower section and an upper section, said first arm member being formed on the left side of the bottom portion extending away from said rear edge, said first arm member having a first end and a second end, said first end of said first arm member being proximate said bottom portion, said lower section of said first arm member being arcuate in form, said upper section of said first arm member being perpendicular to said bottom portion;

a second arm member, said second arm member being contiguously formed with said bottom portion opposite said first arm member, said second arm member having a lower section and an upper section, said second arm member having a first end and a second end, said second arm member being formed on the right side of the bottom portion extending away from said rear edge, said second arm member having a first end and a second end, said first end of said second arm member being proximate said bottom portion, said lower section of said second arm member being arcuate in form, said upper section of said second arm member being perpendicular to said bottom portion;

an upper portion, said upper portion being contiguously formed with said first arm member and said second arm member distal to said bottom portion proximate the second end of the first arm member and the second end of the second arm member, said upper portion being perpendicular in orientation to said bottom portion; and a void, said void being intermediate said first arm member and said second arm member.

5. The boat seat as recited in claim 4, and further including a first support member and a second support member, said second support member being secured to said upper portion, said second support member having a first side and a second side, said first side and said second side of said second support member being inwardly arcuate in form, said second side of said second support member providing user support in the second engagement technique wherein in the second engagement technique a user is standing adjacent to the boat seat.

6. The boat seat as recited in claim 5, wherein the upper portion has a width that is greater than a width of the bottom portion.

7. The boat seat as recited in claim 6, wherein the frame is manufactured from aluminum.

* * * * *